US006168500B1

(12) United States Patent
Weisshaus et al.

(10) Patent No.: US 6,168,500 B1
(45) **Date of Patent: *Jan. 2, 2001**

(54) MONITORING SYSTEM FOR DICING SAWS

(75) Inventors: Ilan Weisshaus, Kiriat Bialik; Oded Yehoshua Licht, Haifa, both of (IL)

(73) Assignee: Kulick & Soffa Investments, Inc., Wilmington, DE (US)

( * ) Notice: Under 35 U.S.C. 154(b), the term of this patent shall be extended for 0 days.

This patent is subject to a terminal disclaimer.

(21) Appl. No.: 09/439,140

(22) Filed: Nov. 12, 1999

Related U.S. Application Data

(63) Continuation of application No. 09/182,177, filed on Oct. 29, 1998.

(51) Int. Cl.[7] ..... B24B 49/00
(52) U.S. Cl. ..... 451/8; 451/5
(58) Field of Search ..... 451/8, 5, 9, 41; 125/12, 13.01

(56) References Cited

U.S. PATENT DOCUMENTS

| | | | | |
|---|---|---|---|---|
| 4,942,795 | | 7/1990 | Linke et al. . | |
| 5,029,418 | * | 7/1991 | Bull | 51/281 R |
| 5,718,615 | | 2/1998 | Boucher et al. . | |
| 5,934,973 | * | 8/1999 | Boucher et al. | 451/5 |
| 6,033,288 | * | 3/2000 | Weisshaus et al. | 451/8 |

FOREIGN PATENT DOCUMENTS

| | | |
|---|---|---|
| 4408886A1 | 9/1995 | (DE) . |
| 0476952A2 | 9/1991 | (EP) . |
| 58-155143 | 9/1983 | (JP) . |
| 01275010 | 2/1989 | (JP) . |
| 01182011 | 7/1989 | (JP) . |
| 01209104 | 8/1989 | (JP) . |
| 05177627 | 7/1993 | (JP) . |

OTHER PUBLICATIONS

International Search Report for international application No. PCT/US99/23926, dated Feb. 4, 2000.

* cited by examiner

*Primary Examiner*—Timothy V. Eley
*Assistant Examiner*—Dung Van Nguyen
(74) *Attorney, Agent, or Firm*—Ratner & Prestia

(57) ABSTRACT

A method and apparatus for accumulating dicing data for process analysis, monitoring process stability and cut quality in a substrate. The apparatus has a spindle motor with a blade attached to the spindle motor. A spindle driver is coupled the spindle to drive the spindle at a predetermined rotation rate. A sensor is connected to the spindle motor to determine the rotation rate of the spindle. A controller is coupled to the monitor in order to control the spindle driver responsive to the load induced on the blade by the substrate.

23 Claims, 7 Drawing Sheets

MONITORING SYSTEM FOR DICING SAWS

This application is a continuation of U.S. patent application Ser. No. 09/182,177, filed Oct. 29, 1998.

FIELD OF THE INVENTION

This invention relates generally to saws of the type used in the semiconductor and electronics industry for cutting hard and brittle objects. More specifically, the present invention relates to a system for monitoring the performance and parameters of a high speed dicing saw during (cutting operations.

BACKGROUND OF THE INVENTION

Die separation, or dicing, by sawing is the process of cutting a microelectronic substrate into its individual circuit die with a rotating circular abrasive saw blade. This process has proven to be the most efficient and economical method use today. It provides versatility in selection of depth and width (kerf) of cut, as we selection of surface finish, and can be used to saw either partially or completely through a wafer or substrate.

Wafer dicing technology has progressed rapidly, and dicing is now a mandatory procedure in most front-end semiconductor packaging operations. It is used extensively for separation of die on silicon integrated circuit wafers.

Increasing use of microelectronic technology in microwave and hybrid circuits, memories, computers, defense and medical electronics has created an array of new and difficult problems for the industry. More expensive and exotic materials, such as sapphire, garnet, alumina, ceramic, glass, quartz, ferrite, and other hard, brittle substrates, are being used. They are often combined to produce multiple layers of dissimilar materials, thus adding further to the dicing problems. The high cost of these substrates, together with the value of the circuits fabricated on them, makes it difficult accept anything less than high yield at the die-separation phase.

Dicing is the mechanical process of machining with abrasive particles. It is assumed that this process mechanism is similar to creep grinding. As, such, a similarity may be found in material removal behavior between dicing and grinding. The theory of brittle material grinding predicts linear proportionality between material removal rate and power input to the grinding wheel. The size of the dicing blades used for die separation, however, makes the process unique. Typically, the blade thickness ranges from 0.6 mils to 50 mils (0.015 mm to 1.27 mm), and diamond particles (the hardest known material) are used as the abrasive material ingredient. Because of the diamond dicing blade's extreme fineness, compliance with a strict set of parameters is imperative, and even the slightest deviation from the norm could result in complete failure.

FIG. 1 is an isometric view of a semiconductor wafer 100 during the fabrication of semiconductor devices. A conventional semiconductor wafer 100 may have a plurality of chips, or dies, 100*a*, 100*b*, . . . formed on its top surface. In order to separate the chips 100*a*, 100*b*, . . . from one another and the wafer 100, a series of orthogonal lines or "streets" 102, 104 are cut into he wafer 100. This process is also known as dicing the wafer.

Dicing saw blades are made in the form of an annular disc that is either clamped between the flanges of a hub or built on a hub that accurately positions the thin flexible saw blade. As mentioned above, the saw blade employs a fine powder of diamond particles that are held entrapped in the saw blade as the hard agent for cutting semiconductor wafers. The blade is rotated by an integrated DC spindle-motor to cut into the semiconductor material.

Optimizing the cut quality and reducing process variation requires an understanding of the interaction between the dicing tool and the material (substrate) to be cut. The most accepted model for material removal by abrasion is described in *Wear Mechanisms in Ceramics*, A. G Evans and D. B Marshal, ASME Press 1981, pp. 439–452. This model predicts the threshold load that must be applied by the abrasive grain to cause fracture of the brittle ceramic. The cracks create localized fracture in the material in predicted directions. Material is removed as particles when some of the cracks join in three dimensions. The Evans and Marshall model predicts the linear relation between the volume of material removed by an abrasive particle and the load exerted by this particle according to the following equation.

$$V = \alpha * \frac{Pn}{K} * l \qquad \text{Eq. (1)}$$

where, V is the volume of material removed, Pn is the Peak Normal Load, $\alpha$ is a material independent constant, K is a material constant, and l is the cut length. The value of $\alpha/K$ is in the range of 0.1 to 1.0.

Assuming formula reciprocity, it follows that the measured load should have a linear relationship to the material removed. In other words, if a known volume of material is removed, then the abrasive cutting wheel has exerted a known load on the substrate.

According to *Grinding Technology*, S. Malkin, Ellis Horwood Ltd., 1989, pp. 129–139, a high percentage of mechanical energy input turns into heat during the abrasive process. Excessive heat generation due to friction, which may be observed as deviation from the linear relationship between material removal and load, can cause damage to the workpiece and/or dicing blade, possibly resulting in destruction of one or both.

Prior art systems for monitoring dicing operations rely on visual means for determining the quality of the cut in the substrate. These prior art systems have the drawback that the cutting process must be interrupted in order to visually inspect the kerfs. Furthermore, only short sections of the cut are evaluated in order to avoid the excessive time requirements for a 100% inspection. The results of the short section inspection must be extrapolated in order to provide full evaluation. In addition, these visual systems only allow for the inspection of the top surface even though the bottom surface is also subject to chipping. Therefore, evaluation of the bottom of the semiconductor wafer must be performed off-line. That is, by stopping the process and removing the wafer from the dicing saw to inspect the bottom surface of the wafer.

There is a need to monitor blade load during wafer or substrate dicing for optimizing the dicing process and maintaining a high cut quality so as not to damage the substrate, often containing electronic chips valued in the many thousands of dollars. There is also a need to perform monitoring over the entire length of the cut and to av the need for interrupting the process during the monitoring.

SUMMARY OF THE INVENTION

In view of the shortcomings of the prior art, it is an object of the present invention to help optimize the dicing process and monitor the quality of the kerfs placed in a substrate by non-visual means.

The present invention is a dicing saw monitor for optimizing the dicing process and monitoring the quality of kerfs cuts into a substrate. The monitor has a spindle motor with a blade attached to the spindle motor. A spindle driver is coupled the spindle motor to drive the spindle at a predetermined rotation rate. A sensor is connected to the spindle motor to determine the rotation rate of the spindle. A controller is coupled to the monitor in order to control the spindle driver responsive the load induced on the blade by the substrate.

According to another aspect of the invention, the controller automatically controls at least one of the speed of the spindle, tie feed rate of the substrate, the cutting depth and a coolant feed rate in response to the load placed on the blade.

According to still another aspect of the invention, the load on the blade is measured based on the current required to maintain a predetermined rotation rate o blade.

According to yet another aspect of the present invention, the current voltage of the spindle motor is measured periodically.

According to a further aspect of the present invention, a display is used to display a variety of conditions of the dicing saw in real-time.

These and other aspects of the invention are set forth below with reference to the drawings and the description of exemplary embodiments of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features; are arbitrarily expanded or reduced for clarity. Included in the drawing are the following Figures.

DETAILED DESCRIPTION

Figure 1:
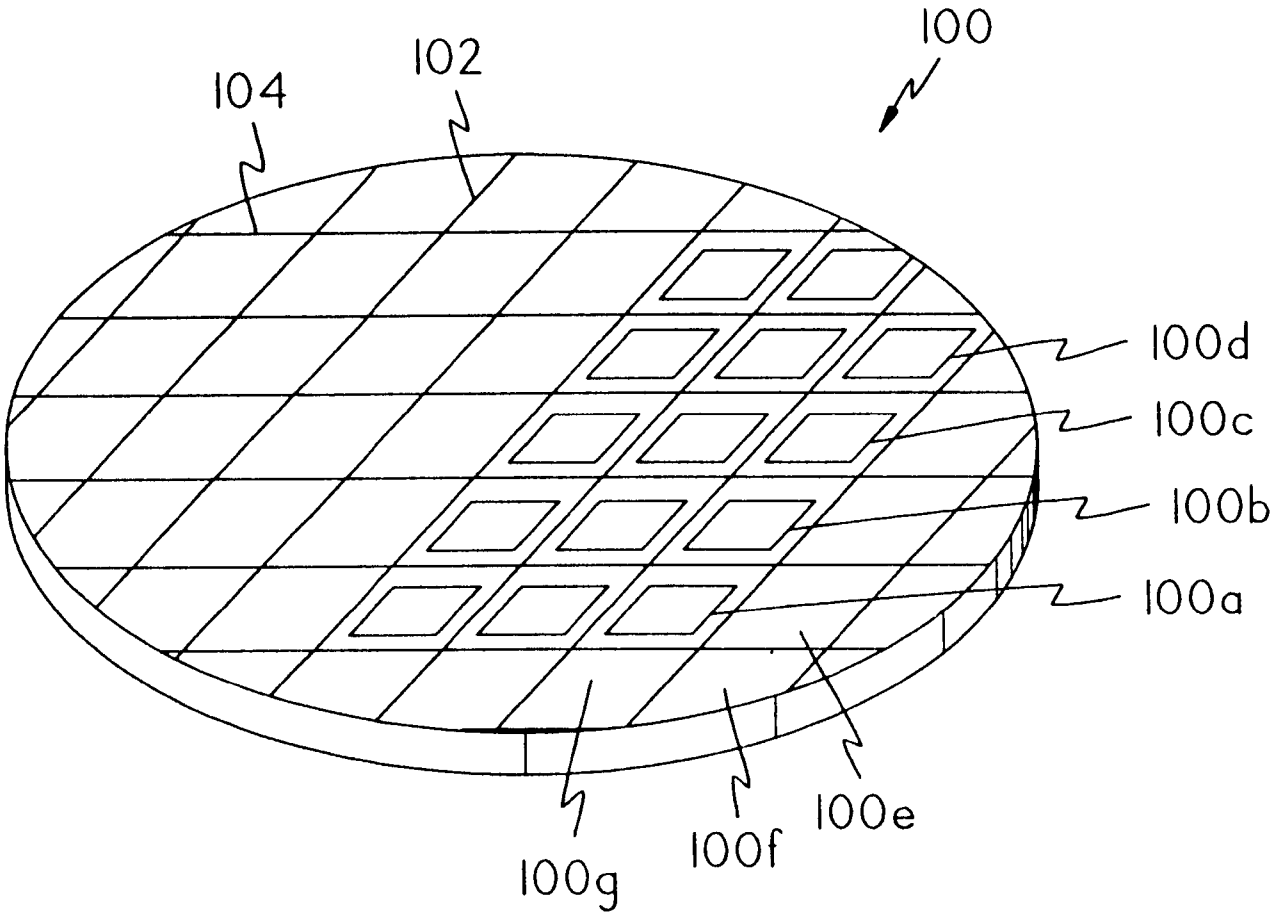
FIG. 1 is an isometric view of a semiconductor wafer used to form semiconductor devices.

In the manufacture of semiconductor devices, individual chips are cut from a large wafer using a very high speed rotating saw blade. In essence, the saw blade grinds away a portion of the wafer along linear streets or kerfs (102, 104 as shown in FIG. 1) in one direction followed by a second operation in an orthogonal direction.

The quality of the chips is directly related to the minimization of chipping during the dicing operation. The inventors have determined that change; in the load on the saw blade-driving spindle cause predictable correlated changes in the electrical current to the motor. These changes may be displayed in real-time to the operator such that required adjustments can be made without interrupting the dicing process.

Figure 2:
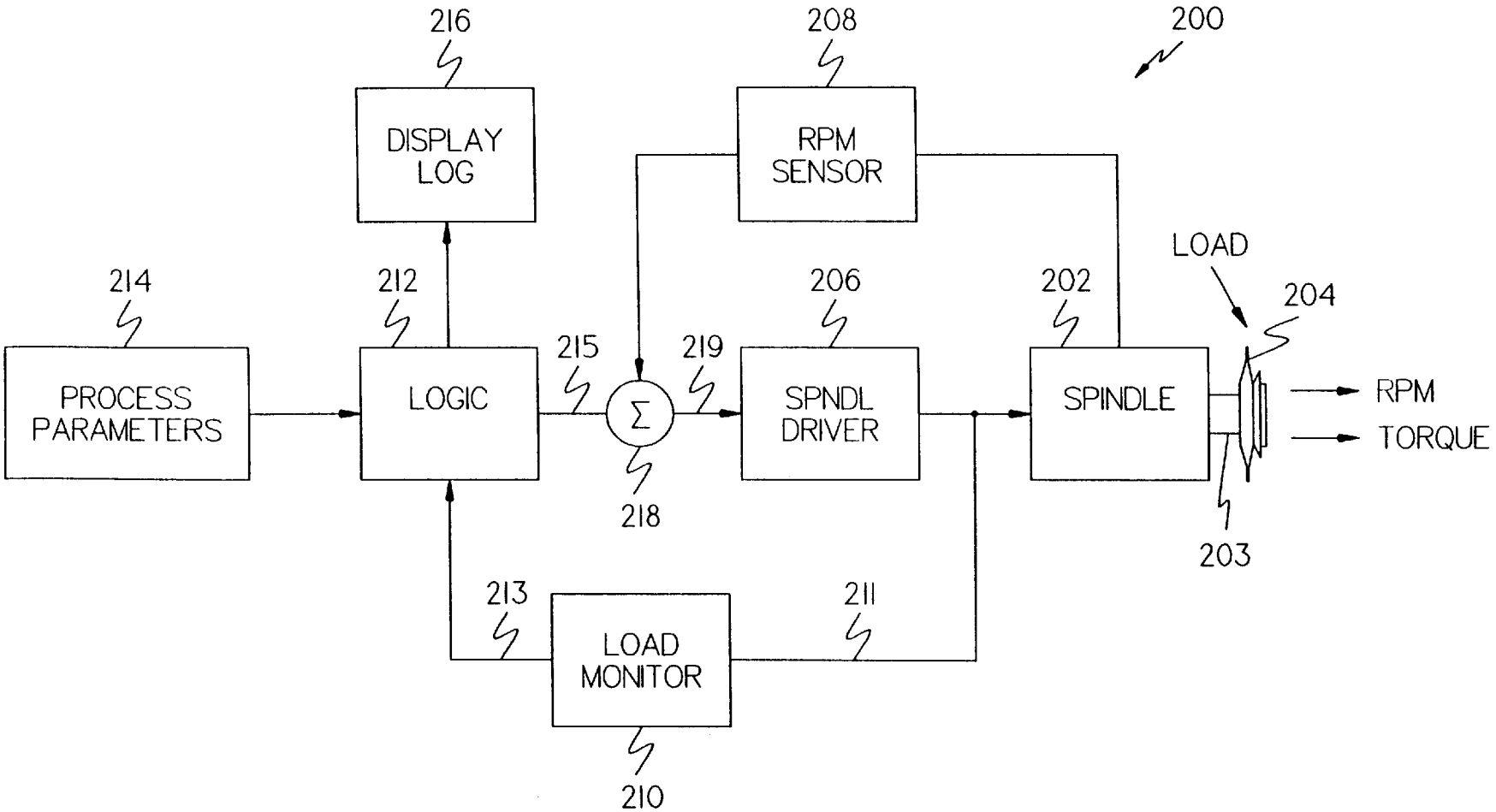
FIG. 2 is a block diagram of an exemplary embodiment of the present invention.

Referring to FIG. 2, an exemplary embodiment of the present invention shown. In FIG. 2, monitor 200 includes spindle motor 202 coupled to saw blade 204 through shaft 203. Current provided by spindle driver 206 drives spindle motor 202 at a rate of between about 2,000 RPM and about 80,000 RPM. The rotation of the spindle motor 202 is monitored by RPM sensor 208 which, in turn, generates an output 209 representative of the rotation rate of spindle motor 202 to summing node 218. In turn, the summing node 218 provides a control signal 219 to spindle driver 206 to control the rotation of spindle motor 202 such that the spindle motor rotates at a substantially constant speed.

Spindle motor 202 generates feedback current 211 which is monitored by load monitor 210. The load monitor 210 periodically determines the feedback current at a rate of between about 10 Hz and 2500 Hz, as desired. The output 213 of load monitor 210 is connected to control logic 212. Control logic 212 also receives process parameters 214. These process parameters 214 may be based on historical data gathered from similar dicing processes, for example. Optionally, the control logic 212 generates control signals 215 which are combined with output 209 of RPM sensor 208 at summing node 218. Summing node 218 operates on these signals and provides signal 219 to control spindle motor 202 based on the process parameters 214, the real-time information from load monitor 210 and the rotation rate of spindle motor 202 as defined by output 209 of RPM sensor 208.

Control logic 212 may also include a filter to determine an RMS value for each of the cuts produced by the blade in the substrate. In addition, control logic 212 may also generate signals for display on display monitor 216. The displayed information may include several parameters, such as present spindle motor speed, cutting depth, blade load, substrate feed rate, coolant feed rate, and the process parameters 214. The display may also provide information related tc processes to follow, such as information received from other process stations which may be connected to the dicing saw monitor via a network, for example. The displayed information and process parameters may be retained in a memory as part of control logic 212 or in a external memory, such as a magnetic or optical media (not shown).

Figure 3:
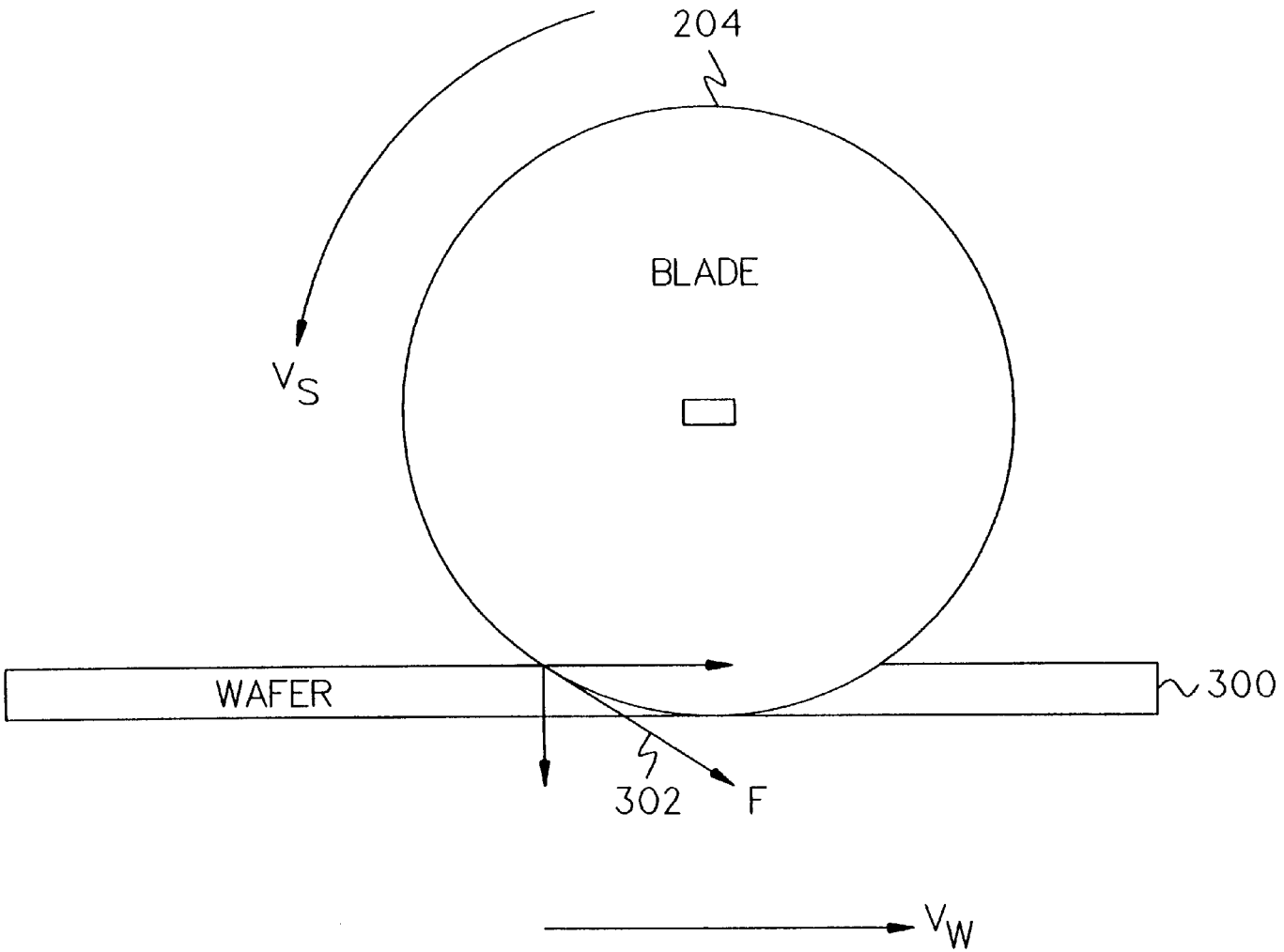
FIG. 3 is a diagram showing the load monitoring principle according to the exemplary embodiment of FIG. 2.

Referring to FIG. 3, the exemplary load monitoring principle is shown. In FIG. 3, blade 204 rotates at a rate Vs while substrate 300 is feed into blade 204 at a rate Vw. A cutting force (F) 302 is exerted by the blade 204 on substrate 300. Cutting force 302 is proportional to the load on the spindle 203 (shown in FIG. 1) which, in turn, is proportional to the current consumption of spindle motor 202 required to maintain the rotational rate Vs.

Using this model the inventors have determined through simulations that the load on the blade 204 is related to the feedback control current 211 according to the following equation:

$$Load = \frac{(FB - 0.04958 * VS + 0.1141)}{(-0.0206 * VS + 7.2065)} * \frac{Lsim}{Lblade} * 288 \qquad \text{Eq. (2)}$$

where, Load is measured in grams, FB is the feedback control current in amps, VS is the spindle speed in KRPM, Lsim is the simulator disk radius, and Lblade is the blade radius. As one of ordinary skill in the art understands, FB may also be measured in volts as current and voltage are proportional to one another according to Ohm's law.

The amount of material removed M from the wafer during dicing operations is measured according to the following equation:

$$M=D*W*FR \quad \text{Eq. (3)}$$

Where, D is the blade cut depth, W is the kerf width, and FR is the feed rate of the wafer into the blade.

To test the material removal rate, the inventors performed a series of experiments according to Table 1.

TABLE 1

| Limits | Cut Depth | Blade Thickness | Feed Rate |
|---|---|---|---|
| Low | 0.002 in. (0.05 mm) | 0.001 in. (0.025 mm) | 2.0 in./sec. (50.8 mm/sec) |
| High | 0.020 in. (0.5 mm) | 0.002 in. (0.05 mm) | 3.0 in.sec. (76.2 mm/sec) |

Figure 4:
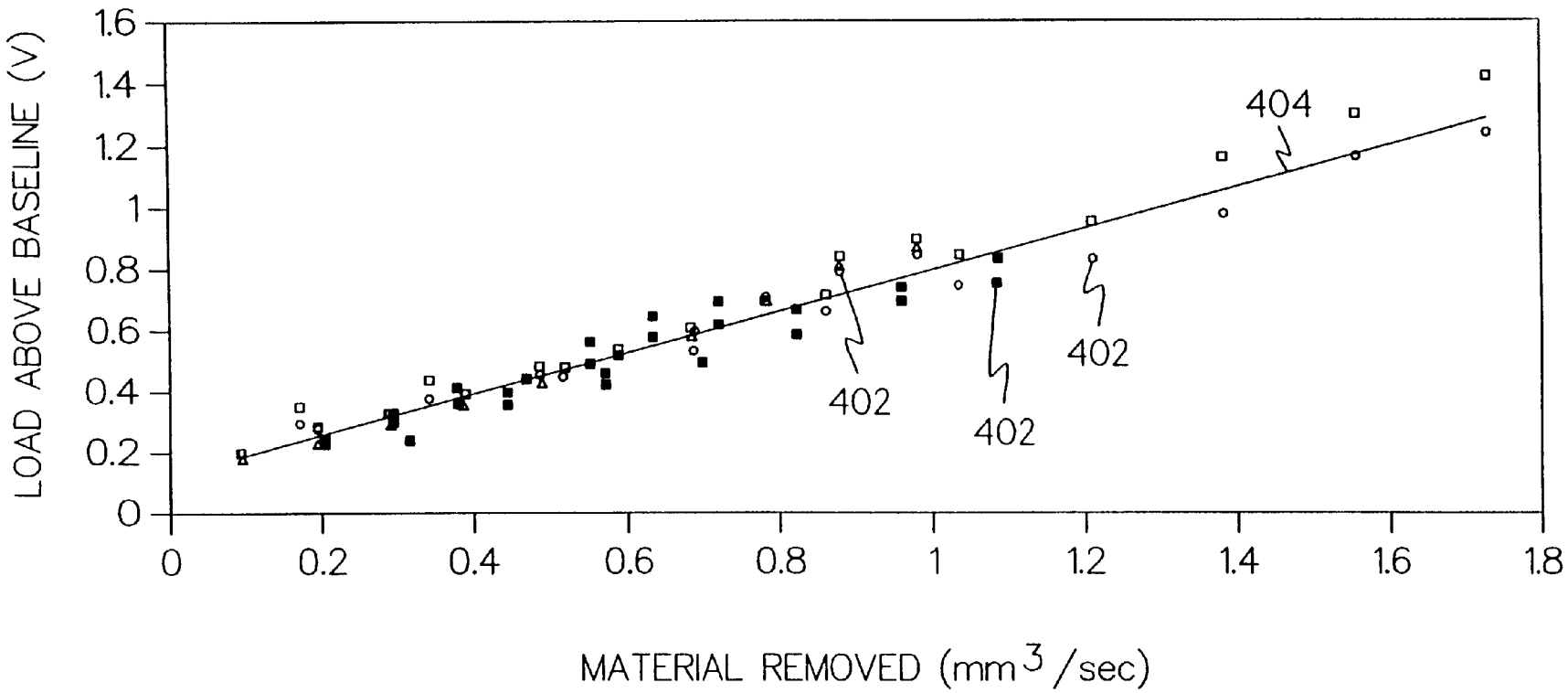
FIG. 4 is a graph of experimental data showing blade load voltage versus substrate material removed.

The tests were performed eight times using silicon wafers. During the tests, one factor (D, W, or FR) was kept constant while the other factors varied. For example, the spindle speed was kept constant and the cut depth was changed at increments of 0.002 in. The results of the tests are shown in FIG. 4. As shown in FIG. 4, the test points 402 are plotted for the various series, of tests. The different symbols shown (▲,■,○,□,etc.) each illustrate a separate test run. The result of these test runs is an essentially straight-line plot supporting the hypothesis presented above in Eq. 3. Although the tests were performed as outlined above in Table 1, in normal process operations, the cutting depth may as deep as about 0.5 in. (12.7 mm) or more depending on the particular process.

Figure 5:
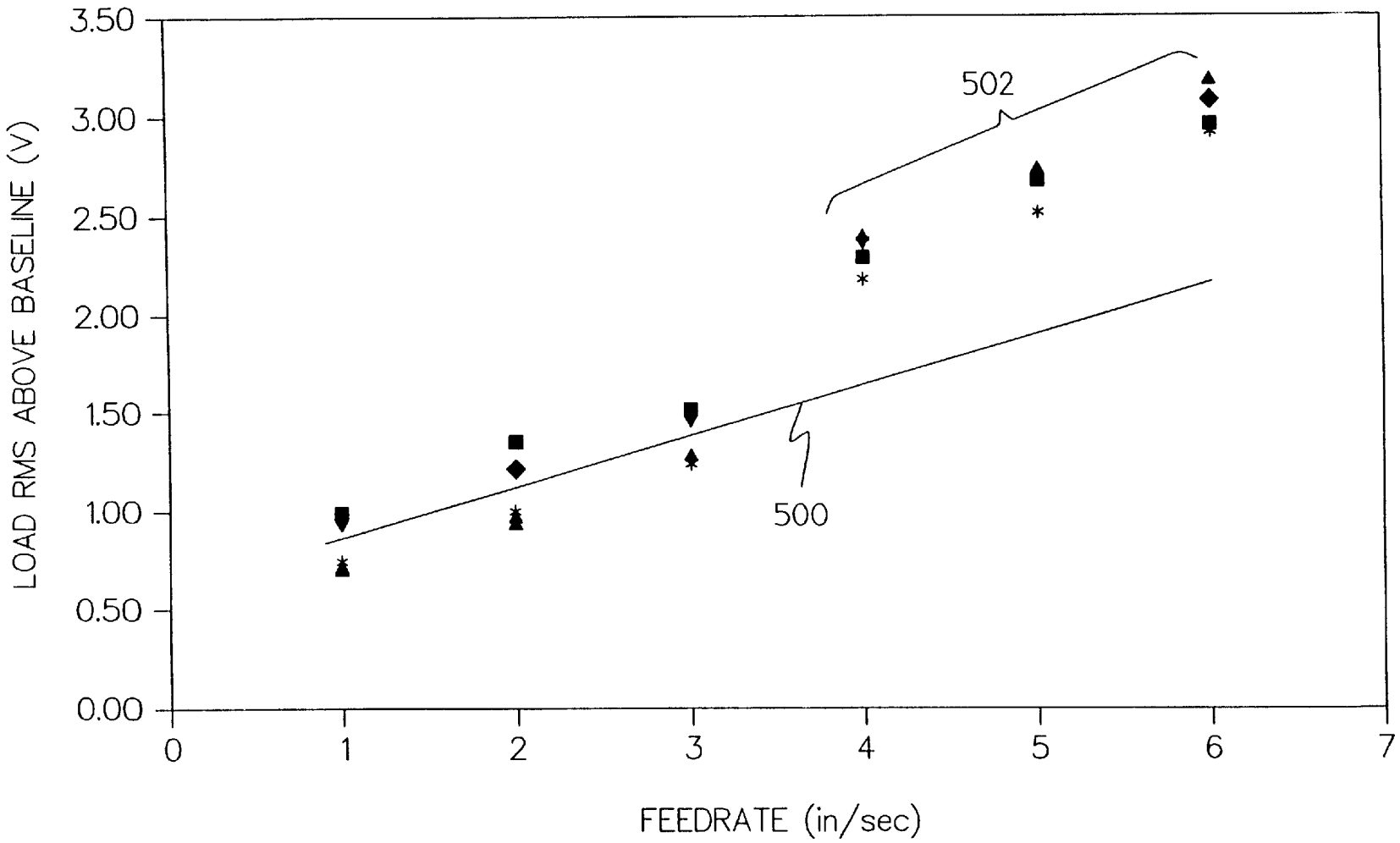
FIG. 5 is of experimental data showing blade load voltage versus substrate feedrate.

FIG. 5 is a graph of RMS load above baseline vs. Feedrate of the wafer with respect to the blade. In FIG. 5, the following parameters were used:

Spindle speed—30,000 RPM

Blade thickness—0.002 in.

Wafer type—6 in. blank

Coolant flow—main jet 1.6 l/min

Cleaning—jet 0.8 l/min

Spray bars—0.8 l/min.

In FIG. 5, plot 500 is the material removal load versus the feedrate of the substrate as measured on the blade. As shown in FIG. 5, it was found that as the feedrate exceeded approximately 3.0 in./sec (78.6 mm/sec) there is a departure from the expected linear behavior as illustrated by points 502. Therefore, in order to maintain the desired linear material removal rate (which has a direct bearing on chipping at the bottom portion of the substrate during dicing operations) one process parameter that may be controlled is the feedrate of the wafer. The feed rate may vary, as desired, between about 0.05 in/sec (1.27 mm/sec) to about 20.0 in/sec (508 mm/sec) depending on the type of material being cut and the condition of the blade.

Figure 6:
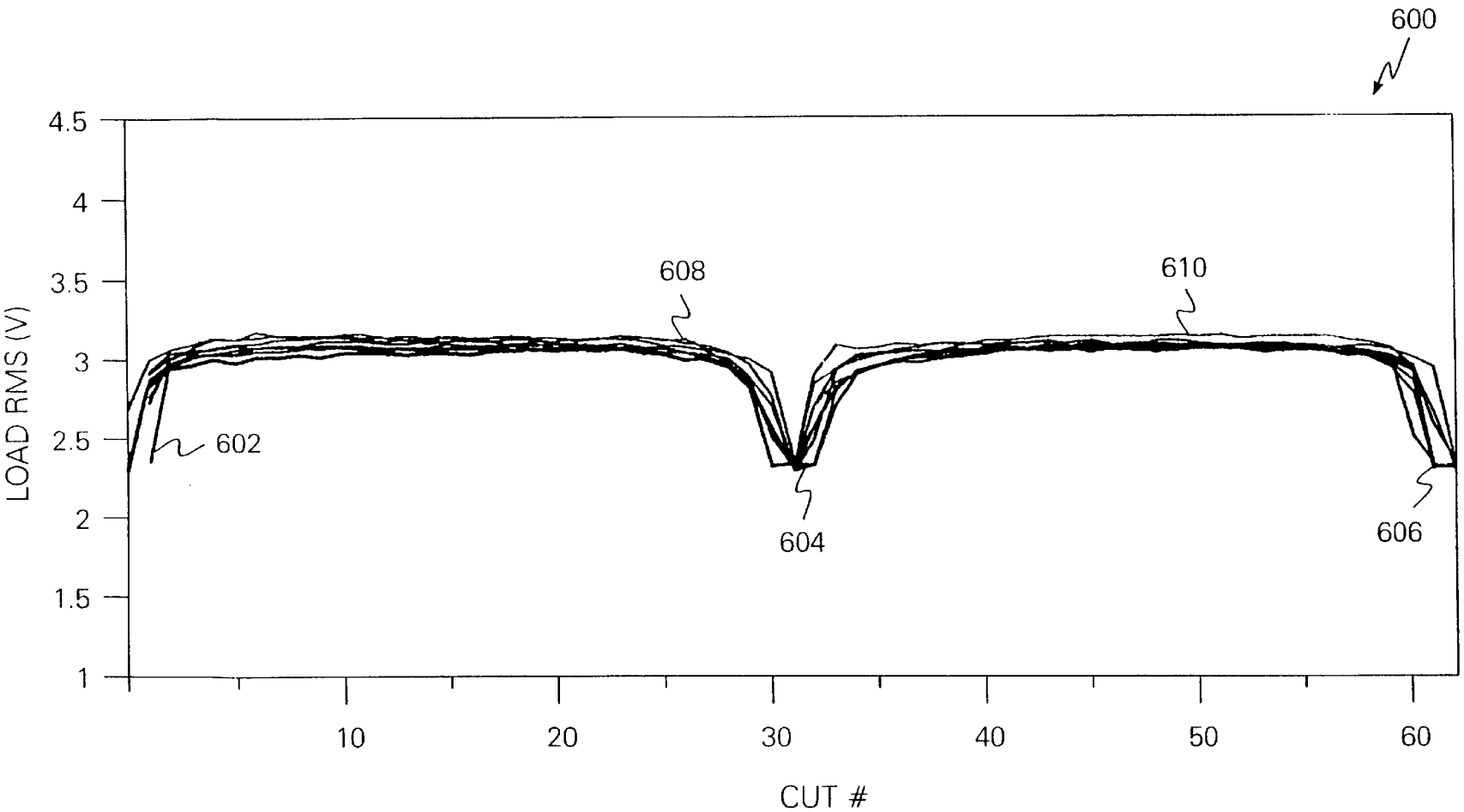
FIG. 6 is a graph illustrating blade load during cutting (dicing) operations.

FIG. 6 is a graph illustrating blade load during cutting operations. In FIG. 6, graph 600 is a plot of load measured in Volts RMS versus cuts placed in the wafer. As shown in FIG. 6, portions 602, 604, 606 of graph 600 indicate a reduction in blade load as compared to portions 608, 610. This is due to the circular nature of the wafer in that the first and last few cuts 102, 104 in any given direction of the wafer 100 (shown in FIG. 1) are short. As a result, the cuts 102, 104 begin and end in the tape (not shown) that is used to mount the wafer 100 and the amount of material removed from the wafer 100 is low which, in turn, are indicated as a lower blade load.

In FIG. 6, the diameter of the wafer is approximately 6 in. (152.4 mm) the cut index is 0.2 in. (5.08 mm). Therefore, at about cut 30 the end of the wafer is reached for the first series of cuts resulting in reduced blade load. Similarly, as the second series of cuts are performed in the second direction in the wafer (usually orthogonal to the first series of cuts), the first cuts and last cuts are detected as reduced blade loads 604 and 606, respectively. Therefore, the exemplary embodiment may also be used to determine when the end of a wafer is reached based on the reduced load on the blade when compared to the expected end of the wafer. In addition, if the blade load is too low at a point where the end of the wafer is not expected, this may indicate a process failure requiring attention of the operator. In this case the operator may be alerted to the situation by a visual and/or audible annunciator. If desired, the process may also be halted automatically.

Figure 7:
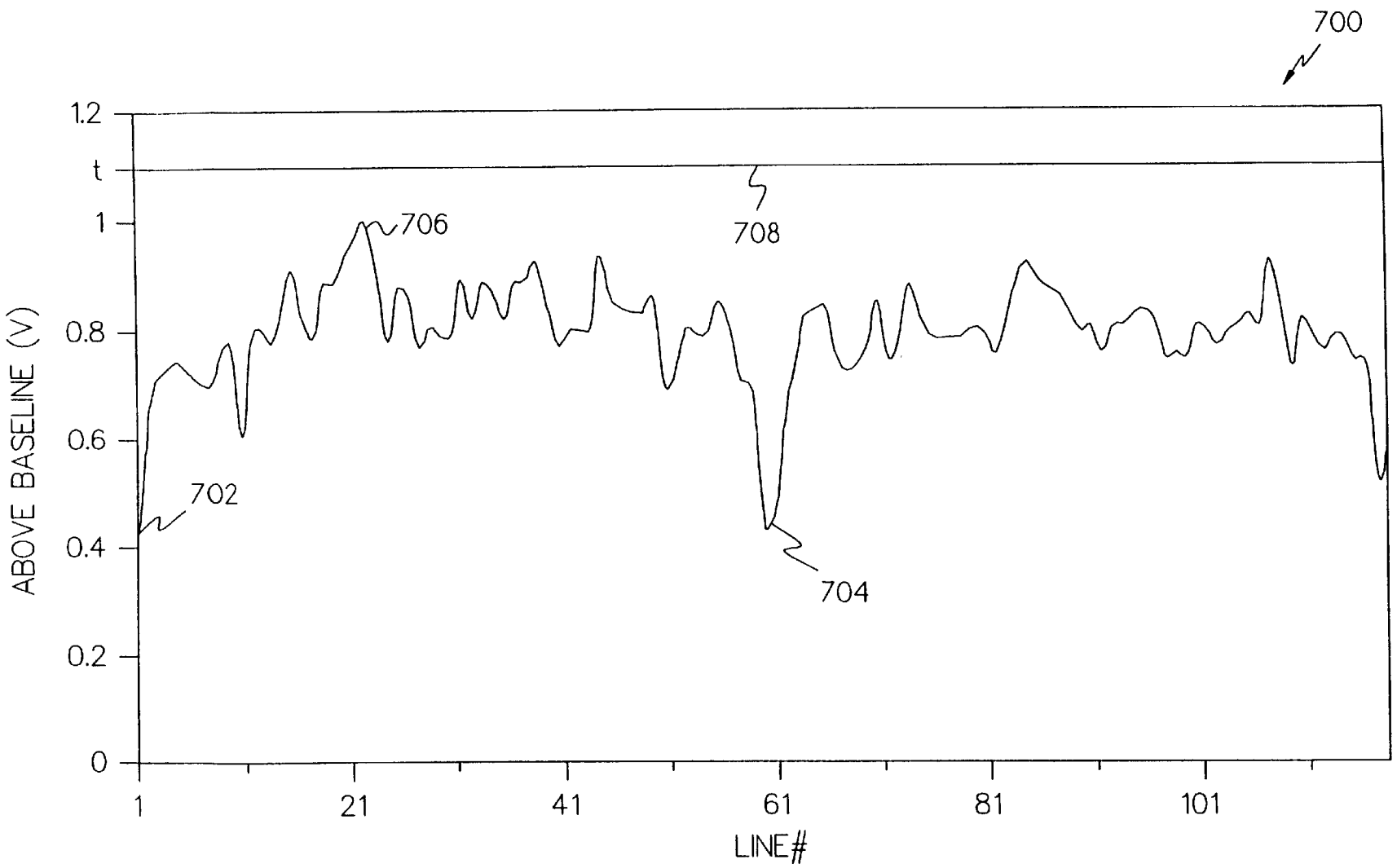
FIG. 7 is another graph illustrating blade loading during dicing operations.

FIG. 7 is another graph illustrating blade loading during dicing operations. In FIG. 7, the ordinate is a measure of load voltage above a predetermined baseline. The baseline may be determined from theoretical, historical or experimental data, for example. As shown in FIG. 7, the load above baseline is low for the first few cuts 702, and the last few cuts 704. The load increases as the cuts progress across, the wafer to a maximum load 706. The exemplary embodiment monitors the feedback voltage (which is directly related to current according to Ohm's law) and may alert the operator or change a parameter of the operation, such as feed rate or cut depth, if the feedback voltage attains or exceeds a predetermined threshold 708. The inventors have found that bottom chipping of the wafer is directly related to the load exceeding a desired value. Therefore, by monitoring the feedback voltage the exemplary embodiment of the present invention is also able to determine chipping of the wafer without the necessity of stopping the process to remove the wafer so as to perform a visual inspection of the bottom of the wafer. Furthermore, excessive load may indicate blade damage or wear which may negatively affect the substrate.

Although the invention has been described with reference to exemplary embodiments, it is not limited thereto. Rather, the appended claims should be construed to include other variants and embodiments of the invention which may be made by those skilled in the art without departing from the true spirit and scope of the present invention.

What is claimed:

1. A device for use with a dicing saw for monitoring process stability and a quality of cuts in a substrate, the device comprising:

a sensor for determining a speed of a blade of the dicing saw;

a monitor for determining a load placed on the blade by the substrate; and a controller coupled to the monitor for controlling the blade responsive to the load.

2. The device according to claim 1, wherein the monitor is coupled to the controller for displaying at least one of i) a speed of the blade, ii) a feed speed of the substrate relative to the blade, iii) a height of the blade above the substrate, and iv) a coolant feed rate.

3. The device according to claim 1, wherein the monitor measures at least one of a feedback control current and a feedback control voltage output from the dicing saw.

4. The device according to claim 1, wherein the blade rotates at a substantially constant speed responsive to a control signal from the controller.

5. The device according to claim 1, wherein the controller automatically controls at least one of i) a speed of the blade, ii) a feed rate of the substrate relative to the blade, iii) a cutting depth of the blade into the substrate, and iv) a coolant feed rite responsive to the load.

6. The device according to claim 5, wherein the cutting depth is between about 0.002 in. (0.050 mm) and 0.050 in. (1.27 mm).

7. The device according to claim 5, wherein the feed rate is between about 0.05 in/sec (1.27 mm/sec) and 20.0 in/sec (508 mm/sec).

8. The device according to claim 5, wherein the feed rate is between about 2.0 in/sec (50.8 mm/sec) and 3.0 in/sec (76.2 mm/sec).

9. The device according to claim 5, wherein the speed of the blade is between about 2,000 rpm and 80,000 rpm.

10. The device according to claim 5, wherein the speed of the blade is between about 10,000 rpm and 57,000 rpm.

11. The device according to claim 1, wherein the monitor measures a current provided to a motor of the dicing saw to determine the load.

12. The device according to claim 11, wherein the current is measured at a frequency of between about 10 Hz to 2500 Hz.

13. The device according to claim 11, wherein the measured current is compared to a baseline current to determine at least one of i) a size and frequency of chipping of the substrate, ii) a kerf width, and iii) a kerf straightness.

14. The device according to claim 11, further comprising a filter to determine a root mean square (RMS) value of the current for each of a plurality of cuts produced by the blade in the substrate.

15. A device for use with a dicing saw for monitoring process stability and a quality of kerfs in a substrate, the device comprising:

a sensor coupled to the dicing saw for determining a rotation rate of a blade of the dicing saw;

a load monitor coupled to the dicing saw for determining a load placed on the blade by the substrate;

a controller receiving i) an output of the load monitor and ii) at least one control parameter for controlling the dicing saw responsive to the load; and an operation circuit coupled to the controller and the sensor to provide a drive signal to the driver based on an output of the sensor and a control signal from the controller.

16. The device according to claim 15, further comprising a monitor coupled to the controller for displaying at least one of i) the rotation rate of the blade, ii) a feed rate of the substrate relative to the blade, iii) a cutting depth of the blade into the substrate, and iv) a coolant feed rate.

17. A method for monitoring process stability and a quality of kerfs cut in a substrate, for use with a saw having a spindle motor and a blade attached to the spindle motor, the method comprising the steps of:

(a) rotating the blade attached to the spindle motor;

(b) determining a speed of the spindle motor;

(c) determining a load placed on the blade by the substrate;

(d) providing operating parameters; and (e) controlling the speed of the spindle based on the operating parameters and responsive to the load placed on the blade by the substrate.

18. The method according to claim 17, further comprising the step of:

(f) cutting kerfs in the substrate.

19. The method according to claim 17, wherein the rotating step rotates the spindle at a substantially constant speed of between about 2,000 rpm and 80,000 rpm.

20. The method according to claim 17, wherein the rotating step rotates the spindle at a substantially constant speed of between about 10,000 rpm and 57,000 rpm.

21. The method according to claim 17, further comprising the step of:

(f) displaying at least one of i) a speed of the spindle, ii) a feed speed of the substrate relative to the blade, iii) a height of the blade above the substrate, iv) a coolant feed rate, and v) a feedback current of the spindle.

22. The method according to claim 21, further comprising the step of:

(g) storing at least one of the operating parameters provided in step (d) and the information displayed in Step (f).

23. A device for use with a saw for monitoring process stability and a quality of cuts in a substrate, the device comprising:

a sensor for determining a speed of a blade of the dicing saw;

a monitor for determining a load placed on the blade by the substrate; and a controller coupled to the monitor for controlling the blade driver responsive to the load.

* * * * *

UNITED STATES PATENT AND TRADEMARK OFFICE

CERTIFICATE OF CORRECTION

PATENT NO. : 6,168,500 B1
DATED : January 2, 2001
INVENTOR(S) : Weisshaus et al.

It is certified that error appears in the above-identified patent and that said Letters Patent is hereby corrected as shown below:

Title page,
Item [73], Assignee, delete "Kulick" and insert -- Kulicke --.

Column 7,
Line 3, delete "rite" and insert -- rate --.

Signed and Sealed this

Tenth Day of August, 2004

JON W. DUDAS
*Acting Director of the United States Patent and Trademark Office*